United States Patent [19]

Bickler

[11] Patent Number: 4,944,516

[45] Date of Patent: Jul. 31, 1990

[54] PUTTING TRAINER DEVICE

[76] Inventor: Henry A. Bickler, 45-750 Pueblo Rd., Indian Wells, Calif. 92210

[21] Appl. No.: 425,574

[22] Filed: Oct. 23, 1989

[51] Int. Cl.[5] ..... A63B 69/36

[52] U.S. Cl. ..... 273/183 B; 273/165; 273/194 R

[58] Field of Search ..... 273/183 B, 165, 166, 273/81 D, 81 A, 81.2, 81.3, 77 R, 194 R, 194 B

[56] References Cited

U.S. PATENT DOCUMENTS 2,273,416 2/1942 Norwood ..... 273/165

4,781,382 11/1988 Hargraves ..... 273/165

*Primary Examiner*—George J. Mario

*Attorney, Agent, or Firm*—Hedman, Gibson, Costigan & Hoare

[57] ABSTRACT

A putting trainer device which attaches to a standard putter at the grip and ensures a consistant angle between the putter's arm and the putter itself to develop "muscle memory" after a period of continuous use and continuation of the consistent arm to putter angle even when the device is not continually used. The device includes an attachment member which runs along the grip of the putter, terminating in a J-hook shaped member designed to engage a hole found in the top of a standard putter grip.

9 Claims, 2 Drawing Sheets

PUTTING TRAINER DEVICE

FIELD OF THE INVENTION

The present invention relates to an instructive or training device, to improve the user's putting, which is mounted on a golf putter to ensure a consistent alignment of the user's arm in relation to the putter.

BACKGROUND OF THE INVENTION

A standard putter used in the game of golf generally comprises a shaft terminating on one end with a "head", having a "face" which makes contact with the ball when putting, and on the other end with a grip engaged by the hands of the user. Generally the top of the grip has a hole in it.

The object of the game of golf is the minimizing of strokes necessary to put the ball in a number of holes around a course. One of the most frustrating aspects of golf can be putting, where the golfer is generally within 30 feet of the hole and at times may take 3 or more strokes to put the ball in the hole.

In an effort to reduce the number of strokes needed when putting, certain techniques have been applied as well as variations in putter size and shape. However, it has been generally recognized that one important aspect is to provide a constant angle of the golfer's rear arm in relation to the putter to develop consistency. The ability to keep a constant angle of the arm to the putter during each putt is difficult when there is no guide to determine differences in the angle.

Therefore, it is an object of the present invention to provide a training device which forces the user to employ execution of proper technique by requiring that golfer maintain a consistent arm to putter angle, and thereby reinforcing a "muscle memory" to continue the proper angle even when the device is not being used.

SUMMARY OF THE INVENTION

The putting trainer device of the present invention is attached to a standard putter and comprises means for attachment of the trainer device to the putter grip and an angled member extending from the means for attachment at a predetermined angle, said angled member terminating with means to engage a user's forearm.

When properly installed on a putter, the angled member to extend from the grip perpendicular to the face of the putter, the user's forearm engages said means to engage and assures a constant angle between the user's arm and the grip of the putter. Continued use of the device instills "muscle memory" in the user and a constant angle can be maintained during putting without continuous use of the device. Periodic use of the device reinforces the user's muscle memory to continue retention of the constant angle and consistent stroke.

BRIEF DESCRIPTION OF THE DRAWINGS

The drawings attached hereto, and made a part hereof, are intended to aid in an understanding of the present invention and are not intended to limit the invention in any manner whatsoever, wherein.

DETAILED DESCRIPTION OF THE INVENTION

Figure 1:
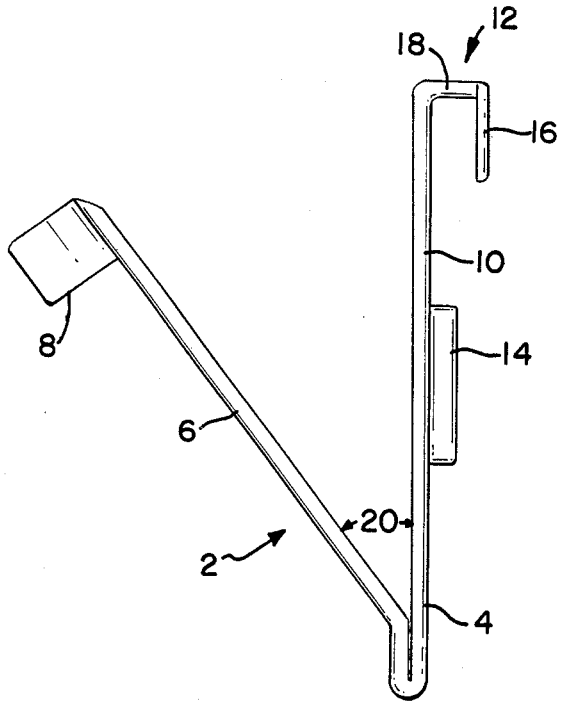
FIG. 1 is a side plan view of the putting trainer device of the present invention.
Figure 2:
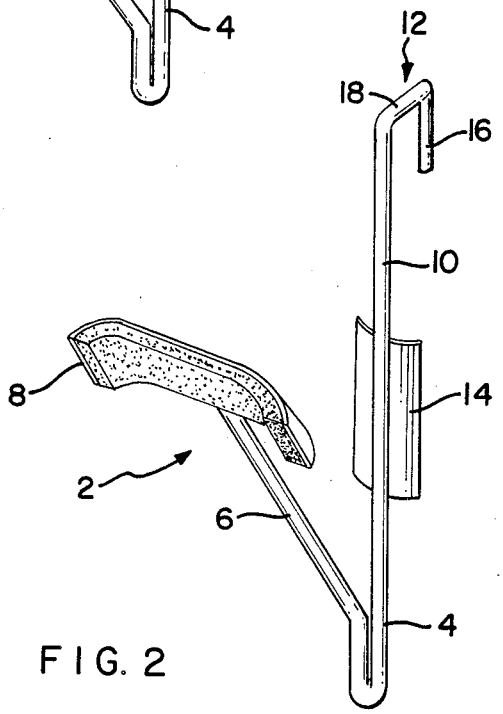
FIG. 2 is a perspective view of the putting trainer device of the present invention.

With reference to the drawings, and particularly FIGS. 1 and 2, the putting trainer device 2 of the present invention comprises means of attachment to the putter grip 4 and an angled member 6 which extends from the means of attachment 4 and terminates in means to engage the user's forearm to provide a constant angle for the user's arm, thereby promoting a consistent stroke during putting.

The means of attachment to the putter grip 4 can be any means, such as a plate which rests against the grip and is fastened to the grip by clamps, i.e. hose clamps, tape, etc. However, in a preferred embodiment to allow ease of installation and removal the means of attachment 4 comprises an attachment member 10, which runs along the grip of the putter, terminating in a J-hook shaped member 12. Between the J-hook member 12 and point from which the angled member 6 extends, the attachment member 10 should have means to engage the grip to provide a steady attachment to the grip, thereby avoiding slippage of the device from the putter during putting. The length of the attachment member 10 corresponds to the distance from the top of the grip to the point along the grip where the user's hands engage the grip.

The J-hook member 12 is designed to engage a hole generally found in the top of a standard putter grip. The terminating portion 16 of the J-hook member 12 is approximately the diameter of the hole, generally about seven-sixtyfourths (7/64) of an inch in diameter. The bottom portion 18 of the J-hook member 12 connects the terminating portion 16 to the attachment member 10 and is generally about the length of the radius of the top of the grip so that when the terminating portion 16 is inserted into the grip hole, the attachment member 10 rides along the length of the putter grip (see FIG. 3).

The attachment member 10 is actually the back portion of the "J" of the J-hook member 12. The attachment member 10 can be made of any rigid or semi-rigid material such as a metal or plastic. As described above, it is preferred that the attachment member 10 have means to engage the putter grip to avoid slippage of the device 2 from the putter during putting.

One such means of engagement is a semi-circular plate 14 which is attached to the attachment member 10 by welding, bolting, gluing or any other known method. The semi-circular configuration is intended to increase the surface or contact area of the attachment member 10 on the putter grip to avoid slippage of the device 2 from the putter. Therefore, the diameter of the semi-circular plate 14 should be about that of the outer diameter of the putter grip. Another means to engage the putter grip can be integral to the attachment member 10, the member 10 itself being formed in a semi-circular shape corresponding to the putter grip.

The angled member 6 is connected to the means of attachment 4 so that the angled member 6 extends from the putter grip at a predetermined angle 20. The angle 20 at which the angled member 6 extends from the putter grip can be any acceptable angle for the user's arm to extend from the grip during the putting stroke. The preferred angle is between 30° and 45° from the putter grip, with an angle of about 37° being most preferred.

The angled member 6 terminates in means to engage the user's arm, preferably comprising a semi-circular or U-shaped member 8 which generally conforms to a forearm. The semi-circular or U-shaped member 8 may have a cushioning pad or similar feature which comforts the user's arm during engagement.

The angled member 6 can be attached to the attachment member 10 by any known means, including welding, gluing, bolting, etc., or the angled member 6 can be made out of the same material as the attachment member 10 in a "one-piece" structure. For example, in the one-piece embodiment the angled and attachment members 6 and 10 can be made of a steel rod which is preformed to the desired angle 20. The rod can be of any shape and size which will be strong enough to withstand the use intended. A three-sixteenth (3/16) inch diameter steel rod has been found to be an adequate material for the angled and attachment members 6 and 10 in a one-piece structure.

Figure 3:
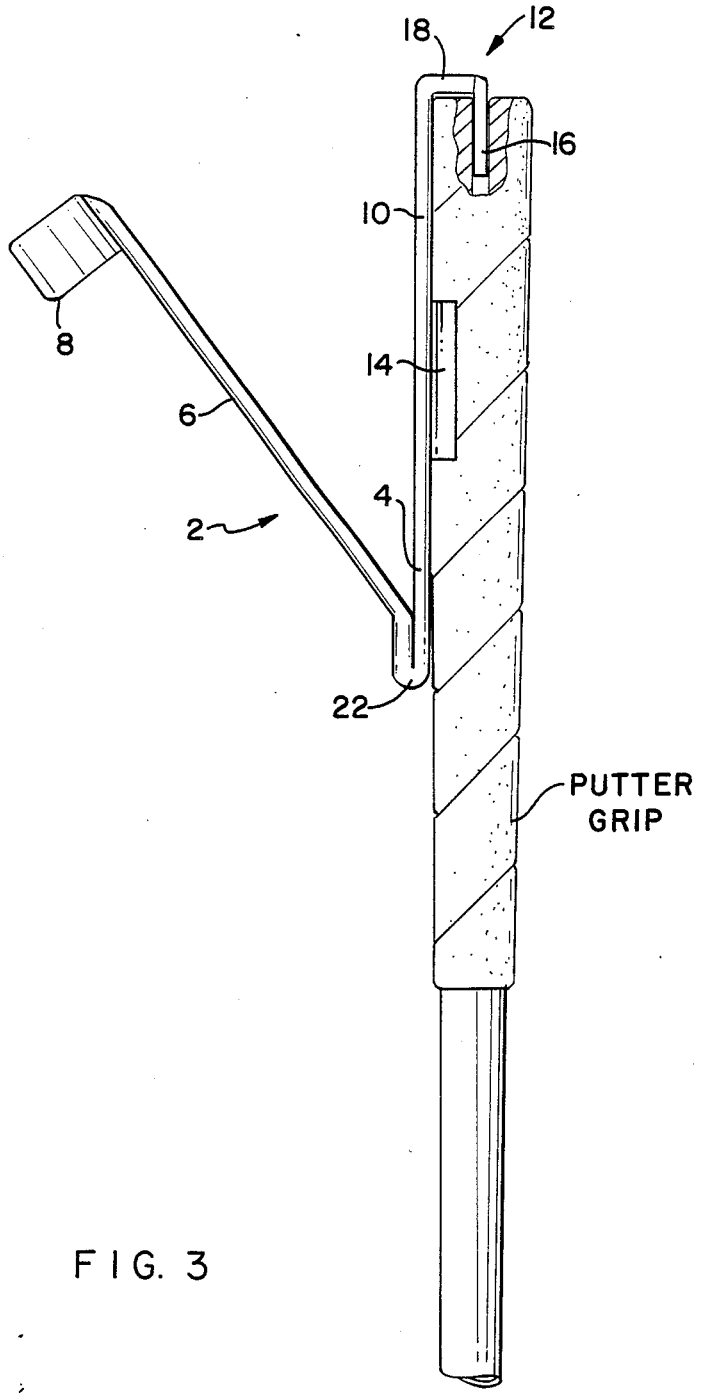
FIG. 3 is a perspective view of the putting trainer device of the present invention installed on a standard putter.

An extension 22 from the attachment and/or angled member, extending along the putter grip, can be included to stabilize the device 2 during putting wherein the palm of the user's hand, on the arm which engages the arm engagement means 8, holds the extension 22 against the putter grip (see FIG. 3).

When a steel rod or bar is used, the means to engage the putter grip 14 and the means to engage the user's arm 8 can be made of a steel plate or strip and attached to the rod or bar by welding, bolting, screwing, etc. Eighteen (18) gauge steel has been found to be adequate for use as arm engagement means 8 and grip engagement means 14.

The preferred embodiment described, preferred for its ease of attachment and removal, is not intended to limit the present invention in any manner whatsoever. Obvious variations, such as the use of a semi-circular shaped attachment means 10 to do away with the means to engage the putter grip, will be apparent to one skilled in the art without departing from the spirit and scope hereof. As such, the present invention is to be limited only by the following claims.

I claim:

1. The device includes an attachment member which runs along the grip of the putter, terminating in a J-hook shaped member designed to engage a hole found in the top of a standard putter grip means for attachment comprising an attachment member connected to the angled member at one end and terminating in a J-hook member at the other end, said J-hook member being adapted to be inserted into a hole at the top of the grip wherein when the device is installed on a putter, the attachment member sits along the putter grip.

2. A putting trainer device as defined in claim 1 further comprising means to engage the putter grip located on the attachment member at a point between the J-hook member and the connection to the angled member.

3. A putting trainer device as defined in claim 2 further comprising an extension from one or both of the attachment and angle members, extending along the putter grip, wherein the palm of the user's hand, on the arm which is engaged by the engagement means, holds the extension against the grip to stabilize the device during use.

4. A putting trainer device as defined in claim 1 wherein the angled member and the attachment member are made of the same material.

5. A putting trainer device as defined in claim 4 wherein the angled member and attachment member are made of a steel rod.

6. A putting trainer device as defined in claim 5 wherein the steel rod is about three-sixteenths (3/16) of an inch in diameter

7. A putting trainer device as defined in claim 1 wherein the means to engage a user's forearm further comprises a rigid or semi-rigid plate lined with a pad which comforts the user's arm during use.

8. A putting trainer device as defined in claim 1 wherein the angled member extends from the putter grip at an angle of between 30° and 45°.

9. A putting trainer device as defined in claim 8 wherein the angled member extends from the putter grip at an angle of about 37°.

* * * * *

UNITED STATES PATENT AND TRADEMARK OFFICE

CERTIFICATE OF CORRECTION

PATENT NO. : 4,944,516

DATED : July 31, 1990

INVENTOR(S) : Henry A. Bickler

It is certified that error appears in the above—identified patent and that said Letters Patent is hereby corrected as shown below:

Delete Claim 1 and insert therefor:

1. A putting trainer device to be attached to a standard putter comprising means for attachment to the putter grip and an angled member connected to the means for attachment to the putter grip at a predetermined angle, said angled member terminating with means to engage a user's forearm, said means for attachment comprising an attachment member connected to the angled member at one end and terminating in a -

UNITED STATES PATENT AND TRADEMARK OFFICE
CERTIFICATE OF CORRECTION

PATENT NO. : 4,944,516

DATED : July 31, 1990

INVENTOR(S) : Henry A. Bickler

It is certified that error appears in the above-identified patent and that said Letters Patent is hereby corrected as shown below:

J-hook member at the other end, said J-hook member being adapted to be inserted into a hole at the top of the grip wherein when the device is installed on a putter, the attachment member sits along the putter grip.

Signed and Sealed this

Fifth Day of November, 1991

*Attest:*

HARRY F. MANBECK, JR.

*Attesting Officer*

*Commissioner of Patents and Trademarks*